US009312635B2

(12) United States Patent
Yagi et al.

(10) Patent No.: US 9,312,635 B2
(45) Date of Patent: Apr. 12, 2016

(54) LOCK ARM AND ELECTRIC CONNECTOR INCLUDING THE SAME

(71) Applicant: DAI-ICHI SEIKO CO., LTD., Kyoto (JP)

(72) Inventors: Sakai Yagi, Shizuoka (JP); Jun Mukunoki, Shizuoka (JP); Takuya Takeda, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/594,657

(22) Filed: Jan. 12, 2015

(65) Prior Publication Data

US 2015/0200486 A1 Jul. 16, 2015

(30) Foreign Application Priority Data

| | | |
|---|---|---|
| Jan. 10, 2014 | (JP) | 2014-003681 |
| Feb. 6, 2014 | (JP) | 2014-021522 |
| Mar. 7, 2014 | (JP) | 2014-045426 |
| Mar. 7, 2014 | (JP) | 2014-045428 |

(51) Int. Cl.
*H01R 13/627* (2006.01)
*H01R 107/00* (2006.01)

(52) U.S. Cl.
CPC ..... *H01R 13/6272* (2013.01); *H01R 2107/00* (2013.01)

(58) Field of Classification Search
CPC ..... H01R 13/6272
USPC ..... 439/353, 357, 358
See application file for complete search history.

(56) References Cited

U.S. PATENT DOCUMENTS

| | | | | |
|---|---|---|---|---|
| 5,370,550 A * | 12/1994 | Alwine | H01R 13/641 439/352 |
| 5,496,190 A * | 3/1996 | Ittah | H01R 13/6272 439/354 |
| 6,364,685 B1 * | 4/2002 | Manning | G02B 6/3879 439/354 |
| 8,777,651 B2 | 7/2014 | Miyawaki | 436/354 |

FOREIGN PATENT DOCUMENTS

| | | | |
|---|---|---|---|
| JP | 61-63782 | 4/1986 | H01R 13/639 |
| JP | 2005-135751 | 5/2005 | H01R 13/639 |
| JP | 2011-243323 | 12/2011 | H01R 13/639 |
| JP | 2013-30323 | 2/2013 | H01R 13/639 |

* cited by examiner

*Primary Examiner* — Tho D Ta
*Assistant Examiner* — Marcus Harcum
(74) *Attorney, Agent, or Firm* — Hayes Soloway P.C.

(57) ABSTRACT

A lock arm formed on a second housing fit into a first housing including a lock unit, includes an elastically deformable lock arm body, first and second legs connecting the lock arm body to the second housing with a gap therebetween, a lock portion to be locked to the lock unit, and an extension obliquely extending from the lock arm body, wherein when the extension is pushed towards the lock arm body, the lock arm body is deformed, then, the extension makes contact with the lock arm body, and then, the lock arm body is deformed with the first and second legs acting as fulcrums and further with an abutment point acting as a working point to thereby allow the lock portion to be released from the lock unit, the extension and the lock arm body making contact with each other at the abutment point.

12 Claims, 8 Drawing Sheets

LOCK ARM AND ELECTRIC CONNECTOR INCLUDING THE SAME

BACKGROUND OF THE INVENTION

1. Field of the Invention

The invention relates to a lock arm equipped in an electric connector to connect the electric connector to another electric connector, and further to an electric connector including the lock arm, to be used for electrical connection between devices equipped in an automobile or various industrial machines.

2. Description of the Related Art

Japanese Patent Application Publication No. 2005-135751 discloses an electric connector including a lock arm, a releaser formed at a rear end of the lock arm, and a support portion flexible enough to extend in a front-rear direction between the lock arm and a female housing. In the electric connector, the lock arm is connected to the support portion at a location closer to a front end of the support portion than a rear end of the support portion, ensuring that the lock arm and the support portion can be arranged in a smaller space above the female housing relative to an electric connector having a lock arm connected to a support portion at a location closer to a rear end of the support portion than a front end of the support portion, and thus, the female connector can be down-sized.

Japanese Patent Application Publication No. 2013-30323 discloses an electric connector including a lock arm, an engagement hook to be engaged with an engagement hole formed at a connector housing, and a lock releaser for releasing the engagement hook from the engagement hole when the lock arm is pushed towards a rear of the housing beyond the engagement hook, a fulcrum located closer to a rear end being positioned closer to the engagement hook than a fulcrum located at a front end in a direction opposite to a direction in which the engagement hook extends.

FIG. 8A illustrates an example of a conventional lock arm formed on an upper surface of a female housing.

The illustrated conventional lock arm 51 includes a lock arm body 52, a front leg 53 supporting a front edge of the lock arm body 52, a rear leg 54 supporting a rear end of the lock arm body 52 on the upper surface of a female housing 50, a lock 55 to be locked with a lock unit of a male housing (not illustrated), and a releaser 56 for releasing the lock 55 from the lock of the male housing.

In the lock arm 51 illustrated in FIG. 8A, the releaser 56 is pushed downwardly in order to release the lock 55 from the lock unit of the male housing. Thus, as illustrated in FIG. 8B, the lock arm body 52 is deformed with the front leg 53 and the rear leg 54 both acting as fulcrums. As illustrated in FIG. 8C, the lock arm body 52 is deformed until the lock arm body 52 makes contact at a lower surface thereof with an upper surface of the female housing 50, resulting in that the lock 55 is released from the lock unit of the male housing.

In the conventional lock arm 51, since the lock arm body 52 is deformed only by a force exerted on the releaser 56, it is necessary to move the releaser 56 downwardly to a great extent to release the lock 55 from the lock unit of the male housing. Accordingly, the conventional lock arm 51 has a problem in that a large space is required between the lower surface of the lock arm body 52 and the upper surface of the female housing 50, which increases the height of the electric connector including the conventional lock arm 51.

SUMMARY OF THE INVENTION

In view of the above-mentioned problem in the conventional lock arm, it is an object of the present invention to provide a lock arm capable of releasing a lock merely by causing a releaser to move by a small distance.

It is another object of the present invention to provide an electric connector including the above-mentioned lock arm.

In one aspect of the present invention, there is provided a lock arm formed on a second housing to be fit into a first housing including a lock unit, the lock arm including a lock arm body extending in a first direction in which the second housing is inserted into the first housing, the lock arm body being elastically deformable in a second direction perpendicular to the first direction, a first leg connecting the lock arm body at one end thereof to the second housing such that a gap is formed between the lock arm body and a surface of the second housing, a second leg connecting the lock arm body at the other end thereof to the second housing such that the gap is formed between the lock arm body and the surface of the second housing, a lock portion to be locked to the lock unit when the second housing is inserted into the first housing, and an extension obliquely extending from the lock arm body in a direction away from the surface of the second housing, wherein when the extension is pushed towards the lock arm body, the lock arm body is deformed with the first and second legs acting as fulcrums, then, the extension makes contact at a distal end thereof with the lock arm body, and then, the lock arm body is deformed with the first and second legs acting as fulcrums and further with an abutment point acting as a working point to thereby allow the lock portion to be released from the lock unit of the first housing, the extension and the lock arm body making contact with each other at the abutment point.

In the lock arm in accordance with the present invention, when the extension is pushed towards the lock arm body, the lock arm body is deformed with the first and second legs acting as fulcrums, then, the extension makes contact at a distal end thereof with the lock arm body, and then, the lock arm body is deformed with the first and second legs acting as fulcrums and further with the abutment point acting as a working point. Thus, the lock portion is able to much displace even if the extension moves by a small distance, and accordingly, the lock portion can be released from the lock unit.

For instance, the second leg may include third and fourth legs formed at opposite ends in a width-wise direction of the second leg.

It is preferable that the lock arm further include a fifth leg formed between the third and fourth legs.

When the extension is pushed towards the lock arm body, then, the extension makes contact with the lock arm body, and then, the lock arm body is deformed with the first and second legs acting as fulcrums and further with the abutment point acting as a working point, the lock arm body can be prevented from being deformed at a rear end thereof and at a center in a width-wise direction thereof, and hence, the lock portion can be moved by a desired distance.

It is preferable that the fifth leg be located at a center between the third and fourth legs.

It is preferable that the lock arm further include a plurality of fifth legs formed between the third and fourth legs.

It is preferable that a gap between a distal end of the extension and the lock arm body be smaller than the gap between the lock arm body and the surface of the second housing.

In another aspect of the present invention, there is provided an electric connector including a housing to be fit into a first housing including a lock unit, and a lock arm formed on an upper surface of the housing, the lock arm being comprised of one of the above-mentioned lock arms.

The advantages obtained by the aforementioned present invention will be described hereinbelow.

The lock arm in accordance with the present invention makes it possible to release the lock portion from the lock unit by causing the extension to displace only by a small distance, and accordingly, makes it possible to fabricate an electric connector in a reduced height.

By designing the lock arm to further include the fifth leg formed between the third and fourth legs, it is possible to prevent the lock arm body from being deformed at a rear end thereof at a center in a width-wise direction thereof, and hence, the lock portion can be moved by a desired distance. Thus, it is possible to release the lock portion from the lock unit by causing the extension to displace only by a small distance.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

Figure 1:
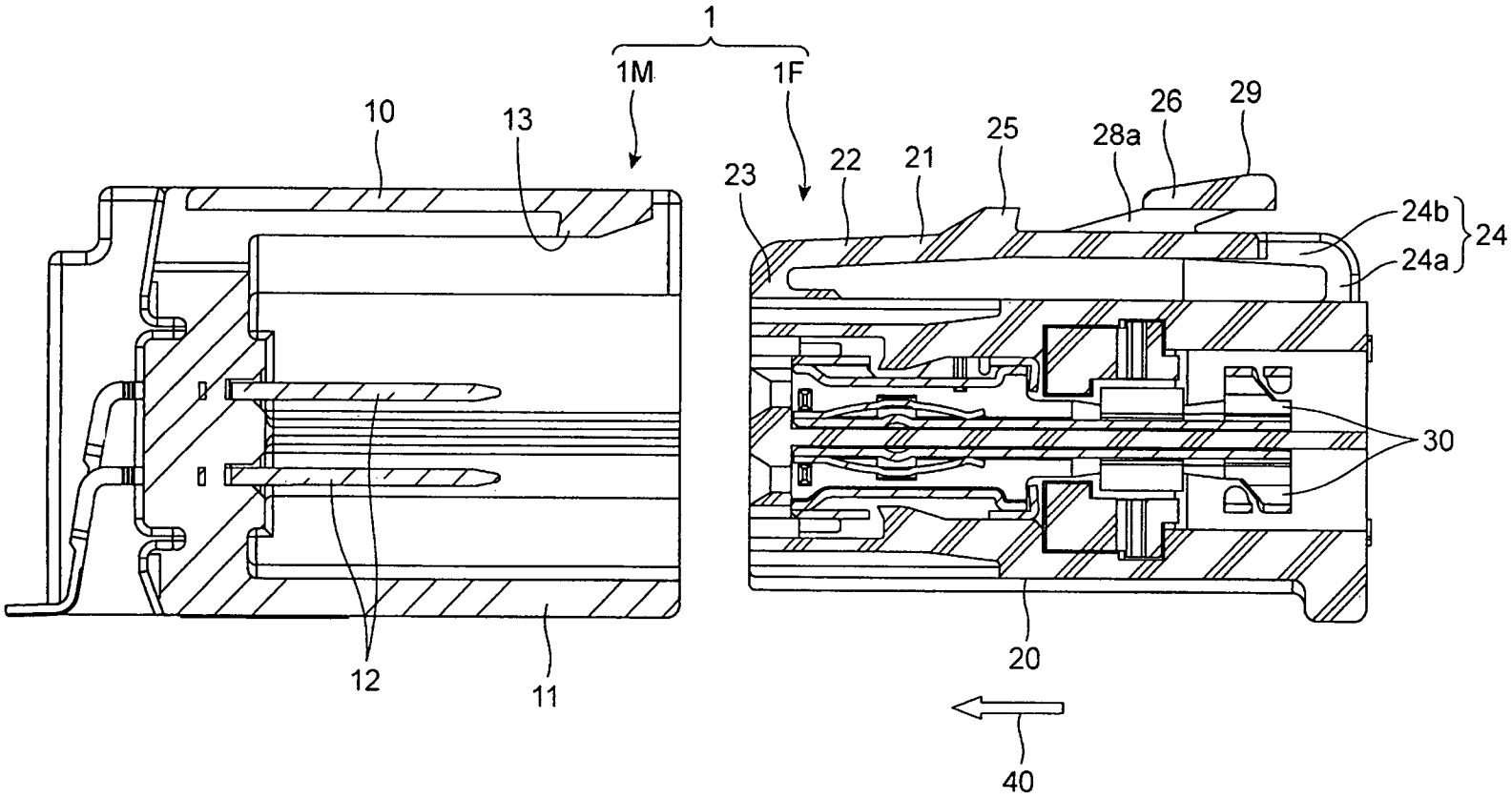
FIG. 1 is a cross-sectional view of an electric connector including a female connector in which a lock arm in accordance with a preferred embodiment of the present invention is fabricated.
Figure 2:
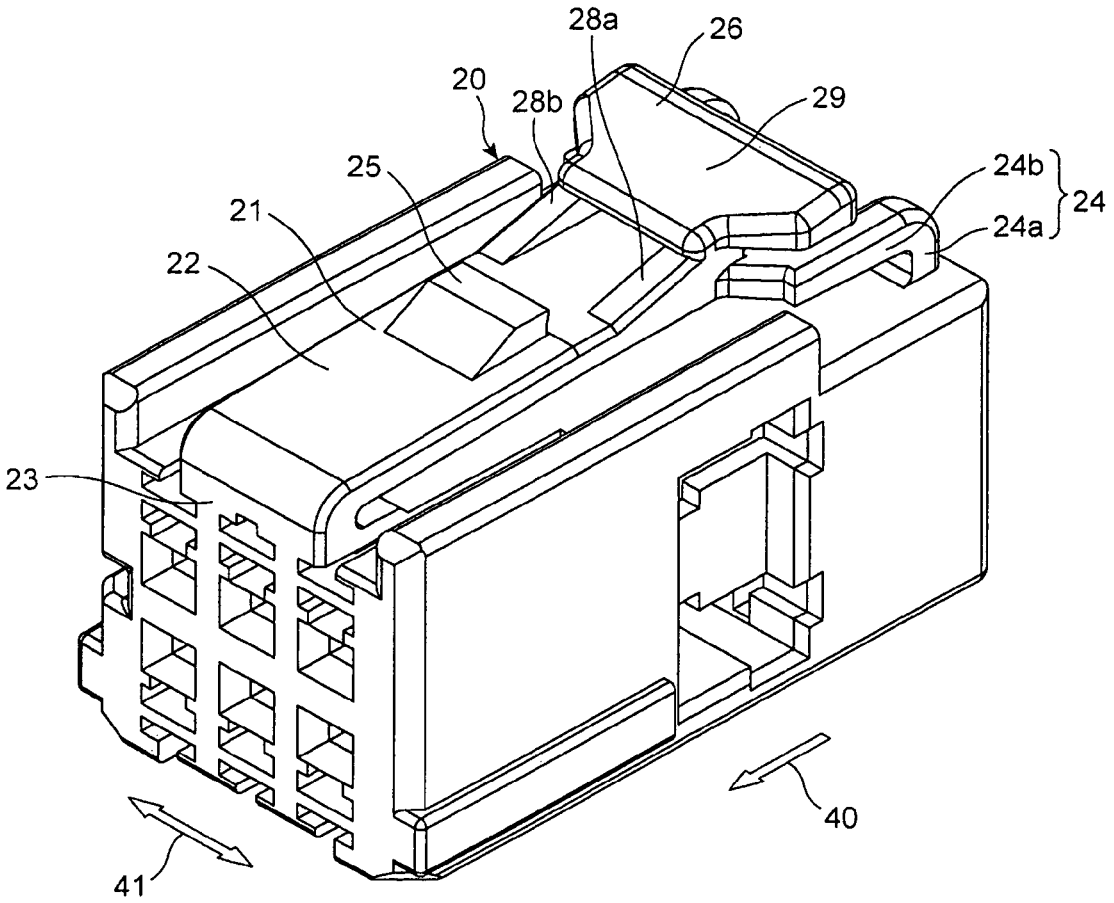
FIG. 2 is a perspective view of a female housing illustrated in FIG. 1.
Figure 3:
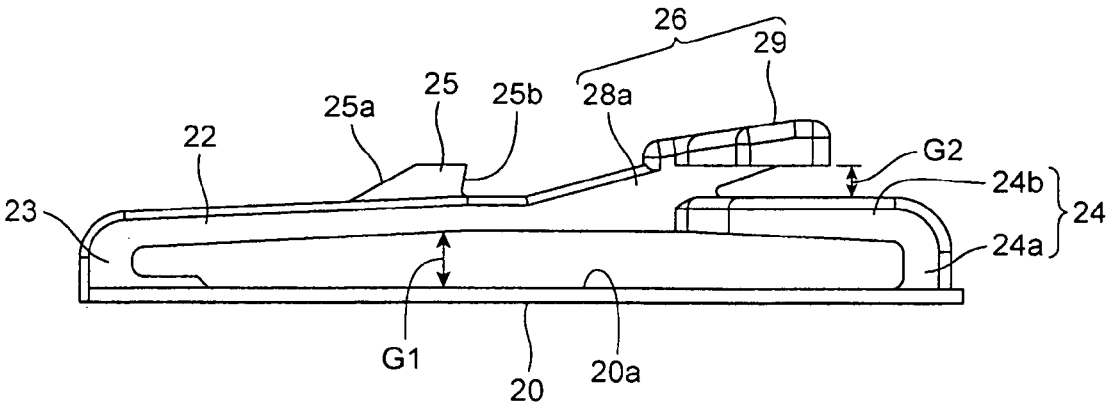
FIG. 3 is a right-side view of the lock arm in accordance with the preferred embodiment of the present invention.
Figure 4:
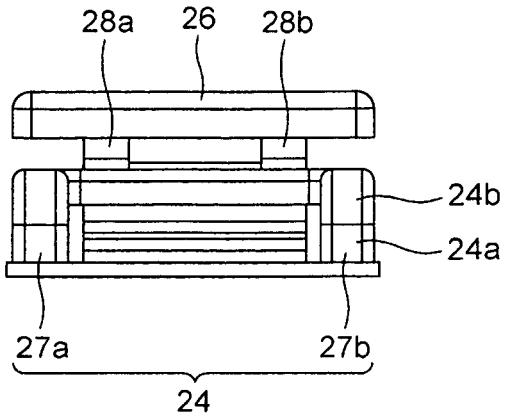
FIG. 4 is a rear view of the lock arm.

FIG. 1 is a cross-sectional view of an electric connector including a lock arm in accordance with a preferred embodiment of the present invention, FIG. 2 is a perspective view of an inner housing illustrated in FIG. 1, FIG. 3 is a right-side view of the lock arm in accordance with a preferred embodiment of the present invention, and FIG. 4 is a rear view of the lock arm.

In FIG. 1, an electric connector 1 includes a male connector 1M and a female connector 1F into which the male connector 1M is fit.

The male connector 1M includes an outer housing 10 as a male housing, and a plurality of male metal terminals 12. The outer housing 10 includes a hood 11 having a rectangular cross-section and opening towards the female connector 1F. The male metal terminals 12 protrude towards the female connector 1F in the hood 11. A lock unit 13 is formed on an inner surface of a top wall of the hood 11 at an end closer to the female connector 1F. The lock unit 13 protrudes from the hood 11 in a width-wise direction (a direction perpendicular to a plane defined by FIG. 1) of the outer housing 10.

The female connector 1F includes an inner housing 20 having a rectangular cross-section, as a female housing, and a plurality of female metal terminals 30 (see FIG. 1) housed in the inner housing 20 to be electrically connected with the male metal terminals 12. The inner housing 20 is fit into the hood 11 of the outer housing 10.

In the specification, a wording "front" refers to a front (on a left-side in FIG. 1) of a direction 40 in which the inner housing 20 is fit into the hood 11 of the outer housing 10, and a wording "rear" refers to a rear (on a right-side in FIG. 1) of the direction 40.

As illustrated in FIGS. 1 and 2, the inner housing 20 is integrally formed with a lock arm 21 on an upper surface 20*a* (a surface facing the lock unit 13 of the outer housing 10) thereof. As illustrated in FIG. 3, the lock arm 21 includes a lock arm body 22 in the form of a plate extending in a length-wise direction of the inner housing 20, a front leg 23 supporting a front edge of the lock arm body 22 on the inner housing 20, a rear leg 24 supporting a rear edge of the lock arm body 22 on the inner housing 20, a lock portion 25 to be locked with the lock unit 13 of the outer housing 10, and a releaser 26 for releasing the lock portion 25 from the lock unit 13 of the outer housing 10.

The lock arm body 22, the front leg 23, the rear leg 24, the lock portion 25, and the releaser 26 are integrally formed on the inner housing 20.

The lock arm body 22 is supported by the front and rear legs 23 and 24 above the upper surface 20*a* of the inner housing 20 so as to create a gap G1 between the lock arm body 22 and the upper surface 20*a* of the inner housing 20. The lock portion 25 upwardly protrudes from the lock arm body 22 between the front leg 23 and the releaser 26. The lock portion 25 has an inclining front surface 25*a* obliquely and backwardly extending from an upper surface of the lock arm body 22, and a rear surface 25*b* vertically standing from the upper surface of the lock arm body 22. The releaser 26 is located at a rear of the lock portion 25, and obliquely extends in a direction away from the inner housing 20. Specifically, the releaser 26 obliquely extends backwardly, that is, towards the rear leg 24.

The front leg 23 protrudes downwardly from the front edge of the lock arm body 22. The front leg 23 is connected at a lower end thereof with the upper surface 20*a* of the inner housing 20 at a front end of the inner housing 20. The lock arm body 22 upwardly inclines between the front leg 23 and the lock portion 25, and extends in parallel with the upper surface 20*a* of the inner housing 20 between the lock portion 25 and the rear leg 24.

The rear leg 24 includes a standing portion 24*a* vertically standing at a rear end of the inner housing 20 from the upper surface 20*a* of the inner housing 20, and an extended portion 24*b* horizontally forwardly extending from an upper end of the standing portion 24*a*.

As illustrated in FIG. 4, the rear leg 24 includes a left leg 27*a* and a right leg 27*b* situated at opposite ends in a width-wise direction of the rear leg 24. Each of the left leg 27*a* and the right leg 27*b* is comprised of the above-mentioned standing portion 24*a* and extended portion 24*b*.

The lock arm body 22 is supported at a front end thereof by the front leg 23 on the inner housing 20, and at a rear end thereof by the standing portion 24*a* of the rear leg 24 on the inner housing 20, and is elastically deformable vertically, that is, in a direction perpendicular to the upper surface 20*a* of the inner housing 20 with the front leg 23 and the standing portion 24*a* both acting as fulcrums. Not only the lock arm body 22, but also the extended portion 24*b* of the rear leg 24 can be elastically deformable.

The releaser 26 includes a pair of extensions 28*a* and 28*b* (see FIG. 2) extending obliquely and backwardly from the upper surface of the lock arm body 22, and a finger contact 29 being in the form of a horizontal plate and connecting upper ends of the extensions 28*a* and 28*b* to each other. The finger contact 29 is located above the extended portion 24*b* of the rear leg 24 with a gap G2 therebetween (see FIG. 3)

Figure 6A:
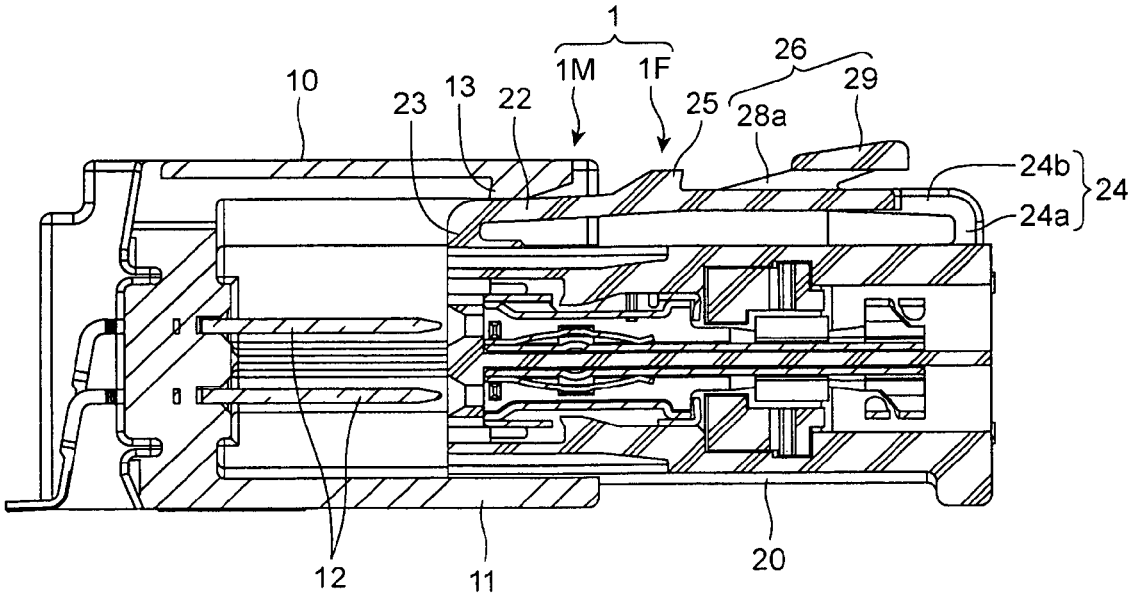
FIG. 6A is a cross-sectional view illustrating that a male connector is being fit into the female connector.
Figure 6B:
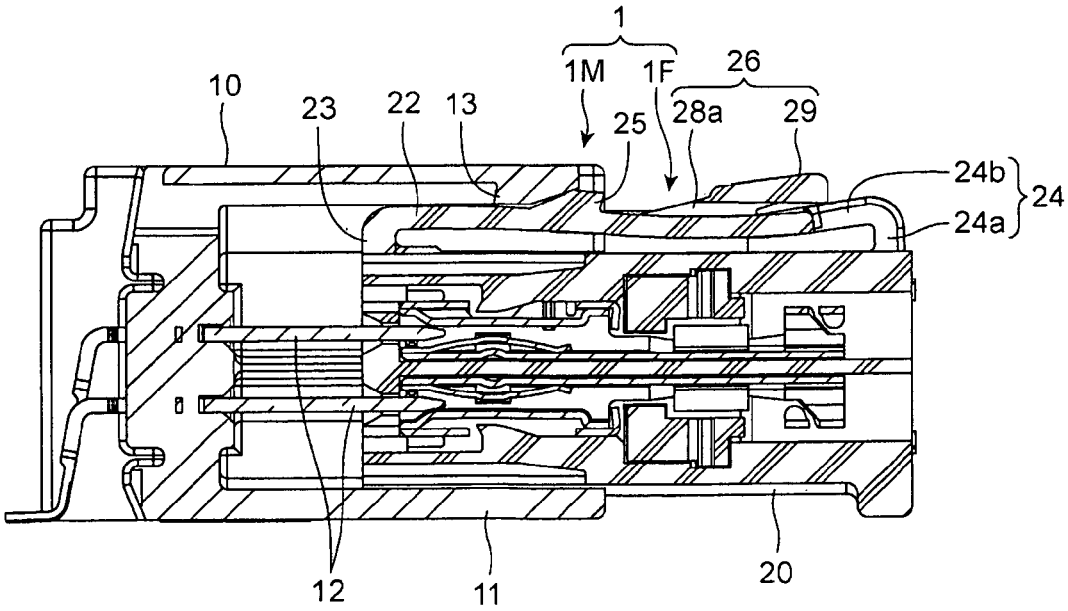
FIG. 6B is a cross-sectional view illustrating that the male connector is being fit into the female connector.
Figure 6C:
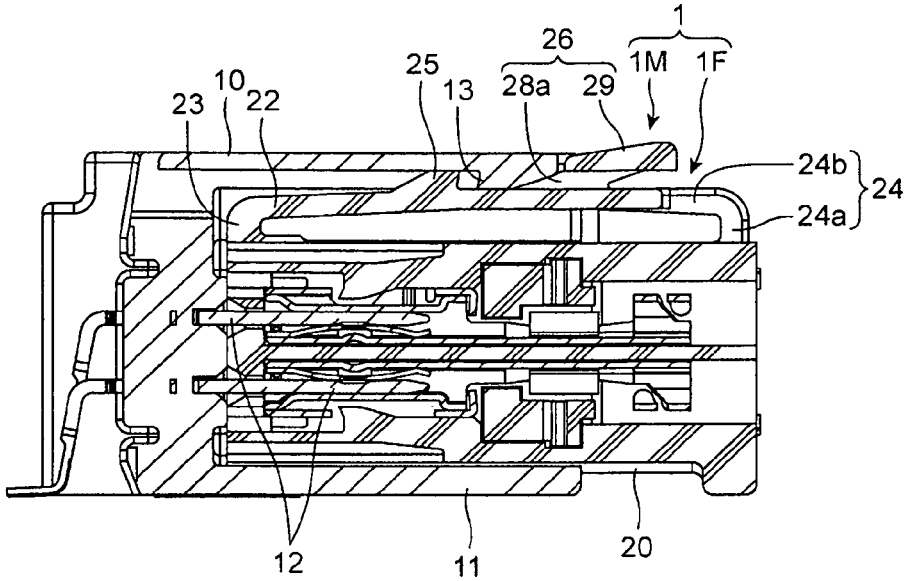
FIG. 6C is a cross-sectional view illustrating that the male connector has been fit into the female connector.

When the male connector 1M is fit into the female connector 1F, as illustrated in FIG. 6A, the inner housing 20 is fit into the hood 11 through a rear of the outer housing 10. When the lock portion 25 of the inner housing 20 is abutted on the lock unit 13 of the outer housing 10 to further push the lock portion 25, the lock arm body 22 is elastically downwardly deformed at a central portion thereof, as illustrated in FIG. 6B, and hence, the lock portion 25 of the inner housing 20 is lowered below the lock unit 13 of the outer housing 10. As illustrated in FIG. 6C, when the lock portion 25 passes over the lock unit 13, the lock arm body 22 recovers to its original shape illustrated in FIG. 6A, and accordingly, the lock portion 25 of the inner housing 20 is engaged or locked with the lock unit 13 of the outer housing 10.

Figure 7A:
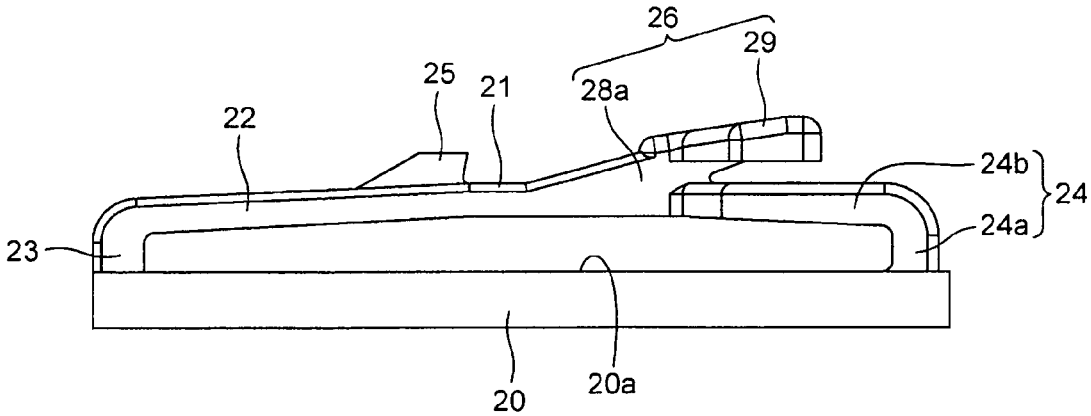
FIG. 7A is a right-side view of the lock arm in such a condition that the male connector is fit into the female connector.
Figure 7B:
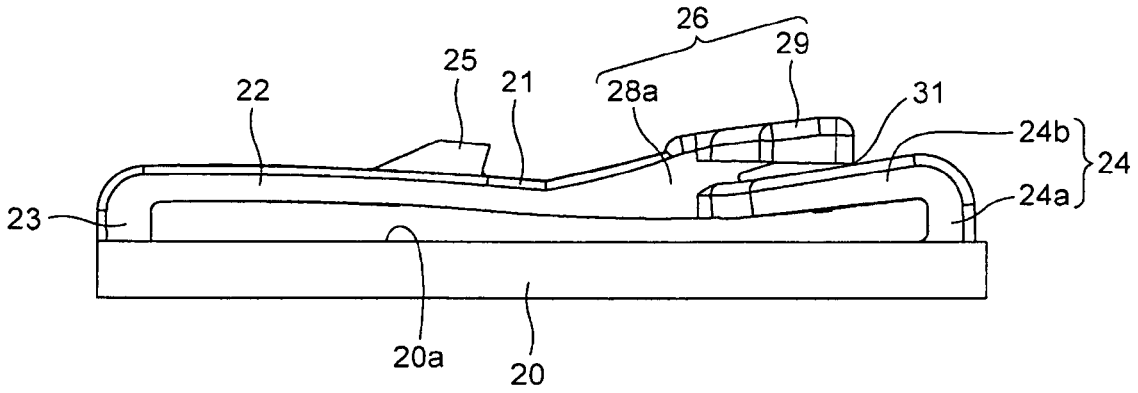
FIG. 7B is a right-side view of the lock arm at a first push-down stage.

When the female connector 1F is released from the male connector 1M, the finger contact 29 is pushed downwardly. As a result, the lock arm body 22 is deformed with the front leg 23 and the standing portion 24*a* of the rear leg 24 both acting as fulcrums, and thus, as illustrated in FIG. 7B, the finger contact 29 makes contact at a lower surface thereof with the extended portion 24*b* of the rear leg 24 (a first push-down stage). The finger contact 29 makes contact with the extended portion 24*b* at an abutment point 31.

Figure 7C:
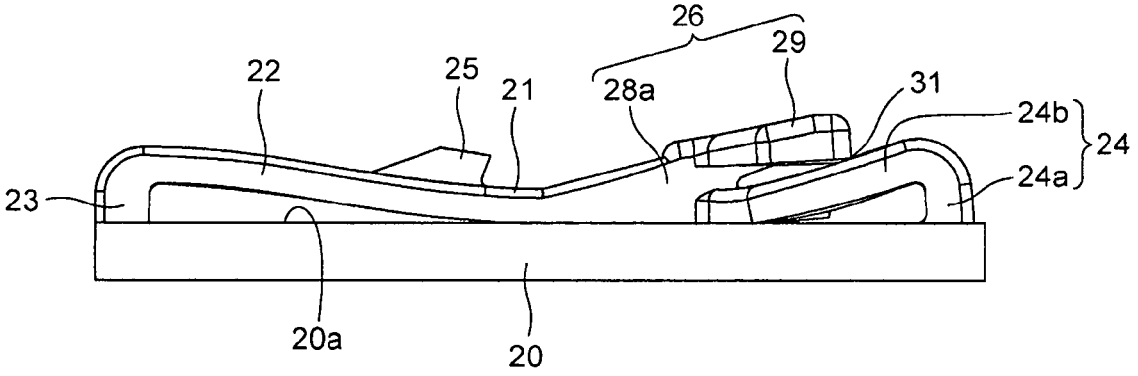
FIG. 7C is a right-side view of the lock arm at a second push-down stage.

Then, as illustrated in FIG. 7C, the lock arm body 22 is deformed with the front leg 23 and the standing portion 24*a* both acting as fulcrums and further with the abutment point 31 acting as a working point (a second push-down stage). Thus, the lock portion 25 is released from the lock unit 13 of the outer housing 10. While the lock portion 25 is kept released from the lock unit 13, the female connector 1F is pulled out of the male connector 1M.

Figure 8A:
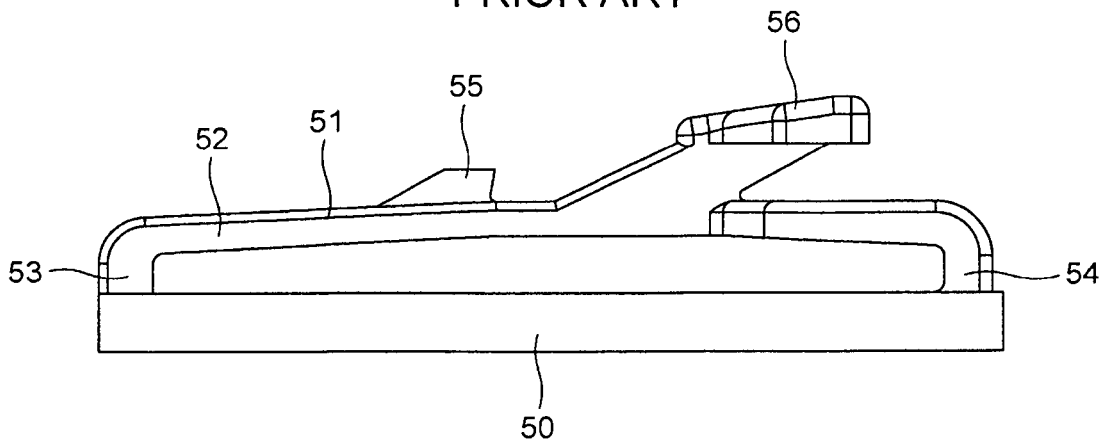
FIG. 8A PRIOR ART
FIG. 8A is a right-side view of a conventional lock arm.
Figure 8B:
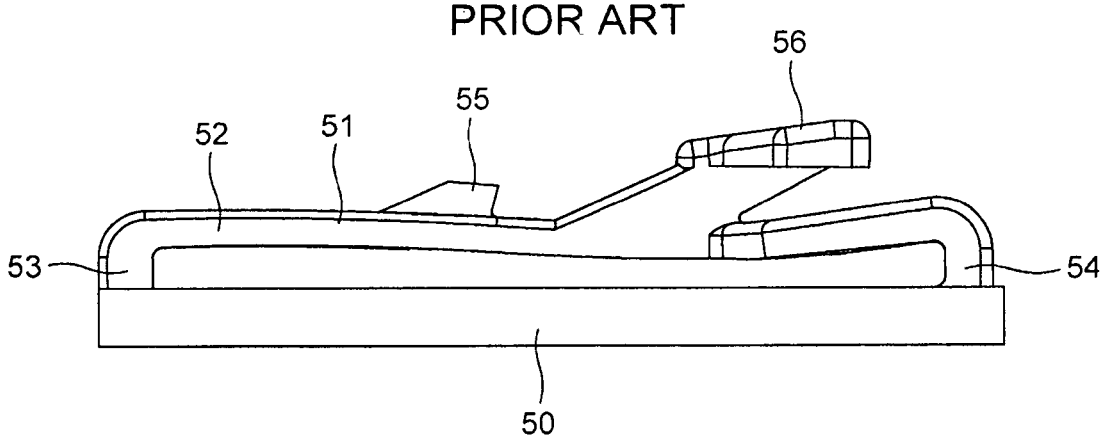
FIG. 8B PRIOR ART
FIG. 8B is a right-side view of the conventional lock arm being pushed downwardly.
Figure 8C:
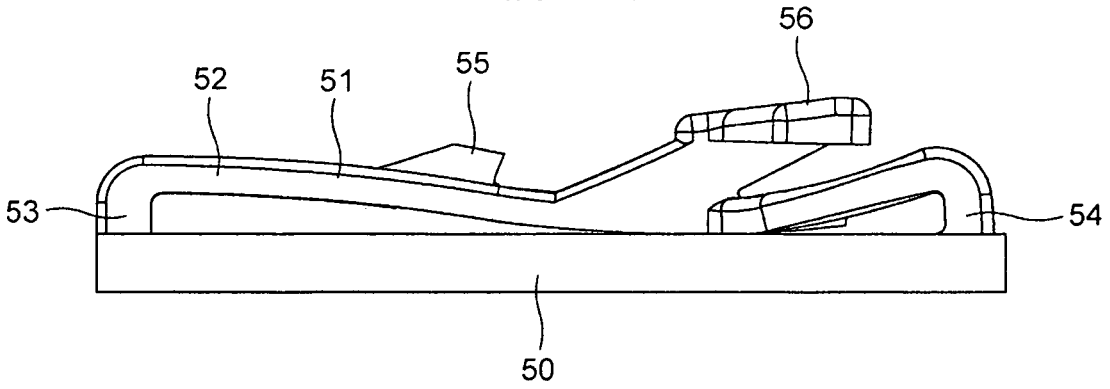
FIG. 8C PRIOR ART
FIG. 8C is a right-side view of the conventional lock arm having been finished to be pushed downwardly.

As explained so far, the lock arm body 22 is deformed first at the first push-down stage, and then at the second push-down stage. Specifically, the lock arm body 22 is deformed in such a way that the front leg 23 and the standing portion 24*a* of the rear leg 24 both act as fulcrums at the first push-down stage, and then, further deformed in such a way that the front leg 23 and the standing portion 24*a* both act as fulcrums and further the abutment point 31 acts as a working point at the second push-down stage. Thus, the lock portion 25 can displace by a longer distance due to a smaller displacement of the releaser 26 in comparison with the conventional lock arm 51 illustrated in FIGS. 8A to 8C, ensuring that the lock portion 25 can be released from the lock unit 13 of the outer housing 10. Since the lock portion 25 can be released from the lock unit 13 with the small displacement of the releaser 26, it is possible to design the electric connector 1 reduced in height.

Figure 5:
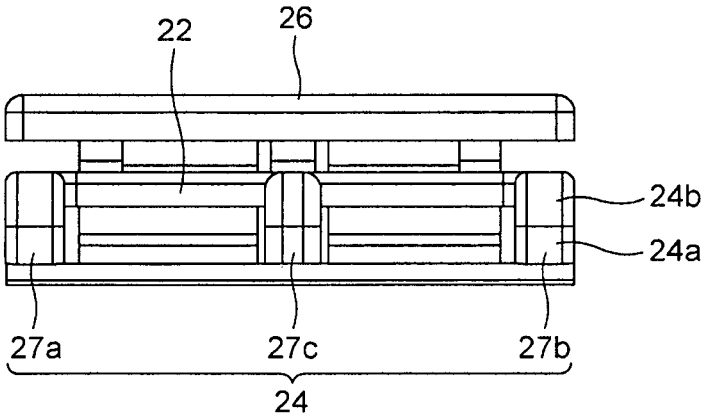
FIG. 5 is a rear view of a lock arm in accordance with a variation of the embodiment.

The rear leg 24 in the present embodiment is designed to include the left leg 27*a* and the right leg 27*b* situated at opposite ends of the rear leg 24 in a width-wise direction of the rear leg 24. When the lock arm 21 is designed to have an increased width, the rear leg 24 may be designed to further include an intermediate leg 27*c* between the left leg 27*a* and the right leg 27*b*, as illustrated in FIG. 5, in which case, since the rear leg 24 is supported on the upper surface 20*a* of the inner housing 20 by the left leg 27*a*, the right leg 27*b* and the intermediate leg 27*c*, when the lock arm body 22 is deformed in such a way that the front leg 23 and the standing portion 24*a* both act as fulcrums and further the abutment point 31 acts as a working point at the second push-down stage, the lock arm body 22 is prevented from being deformed at a rear end thereof and at a central portion in a width-wise direction of the lock arm body 22. Accordingly, it is possible to surely displace the lock portion 25 to be released from the lock unit 13 by virtue of a small displacement of the finger contact 29.

The intermediate leg 27*c* is preferably located at a center between the left leg 27*a* and the right leg 27*b*. It should be noted that the intermediate portion 27*c* may be situated at any location between the left leg 27*a* and the right leg 27*b*. The lock arm 21 may include a plurality of the intermediate legs 27*c* between the left leg 27*a* and the right leg 27*b*.

The lock portion 25 may not be a projection. The lock portion 25 may be any recess that can be engaged with the lock unit 13 of the outer housing 10.

It is preferable that the gap G2 (see FIG. 3) between a distal end of the extensions 28*a*, 28*b* and the lock arm body 22 be smaller than the gap G1 (see FIG. 3) between the lock arm body 22 and the surface 20*a* of the second housing 20. By designing the gap G2 to be smaller than the gap G1, the lock arm body 22 can be facilitated to be deformed first at the first push-down stage, and then at the second push-down stage.

INDUSTRIAL APPLICABILITY

The lock arm in accordance with the present invention is suitable to an electric connector used for accomplishing electrical connection between devices equipped in an automobile and/or an industrial machine.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Applications Nos. 2014-003681, 2014-021522, 2014-045426, and 2014-045428 filed on Jan. 10, 2014, Feb. 6, 2014, Mar. 7, 2014, and Mar. 7, 2014, respectively, including specification, claims, drawings and summary is incorporated herein by reference in its entirety.

What is claimed is:

1. A lock arm formed on a second housing to be fitted into a first housing including a lock unit; said lock arm including:

a lock arm body being supported by a front leg and a rear leg, said lock arm body being elastically deformable in a direction perpendicular to a surface of said second housing; a first portion perpendicularly standing on said surface of said second housing: and a second portion extending from a top end of said first portion substantially in parallel with said surface of said second housing, said lock-releaser including: a pair of walls upwardly and obliquely extending towards said rear leg from said lock arm body between said front leg and said rear leg; and a plate connected to a top end of said walls, extensive substantially in parallel with said surface of said second housing, and spaced away from said second portion of said rear leg; wherein when said lock-releaser is pushed towards said lock arm body, said plate makes contact at a lower end of a rear thereof with said second portion of said rear leg, and then, said lock arm body is deformed with both of said front leg and said rear leg acting as fulcrums and further with an abutment point acting as a working point to thereby allow said lock portion to be released from said lock unit of said first housing, said lock-releaser and said second portion of said rear leg making contact with each other at said abutment point.

2. The lock arm as set forth in claim 1, wherein said rear leg includes third and fourth legs formed at opposite ends in a width-wise direction of said second leg.

3. The lock arm as set forth in claim 2, wherein said rear leg further includes a fifth leg formed between said third and fourth legs.

4. The lock arm as set forth in claim 3, wherein said fifth leg is located at a center between said third and fourth legs.

5. The lock arm as set forth in claim 2, further including a plurality of fifth legs formed between said third and fourth legs.

6. The lock arm as set forth in claim 1, wherein a gap between a distal end of said lock-releaser and said lock arm body is smaller than said gap between said lock arm body and said surface of said second housing.

7. An electric connector including:

a housing to be fitted into a first housing including a lock unit; and a lock arm formed on an upper surface of said housing, said lock arm including:

a lock arm body being supported by a front leg and a rear leg, said lock arm body being elastically deformable in a second direction perpendicular to a surface of said second housing; a lock portion to be locked to said lock unit of said first housing when said housing is inserted into said first housing; and a lock-releaser, said rear leg including: a first portion perpendicularly standing on said surface of said second housing: and a second portion extending from a top end of said first portion substantially in parallel with said surface of said second housing, said lock-releaser including: a pair of walls upwardly and obliquely extending towards said rear leg from said lock arm body between said front leg and said rear leg; and a plate connected to a top end of said walls, extensive substantially in parallel with said surface of said second housing, and spaced away, from said second portion of said rear leg, wherein when said lock-releaser is pushed towards said lock arm body, said plate makes contact at a lower end of a rear thereof with said second portion of said rear leg, and then, said lock arm body is deformed with both of said front leg and said rear leg acting as fulcrums and further with a abutment point acting as a working point to thereby allow said lock portion to be released from said lock unit of the first housing, said lock-releaser and said second portion of said rear leg making contact with each other at said abutment point.

8. The electric connector as set forth in claim 7, wherein said rear leg includes third and fourth legs formed at opposite ends in a width-wise direction of said second leg.

9. The electric connector as set forth in claim 8, wherein said rear leg further includes a fifth leg formed between said third and fourth legs.

10. The electric connector as set forth in claim 9, wherein said fifth leg is located at a center between said third and fourth legs.

11. The electric connector as set forth in claim 8, wherein said rear leg further includes a plurality of fifth legs formed between said third and fourth legs.

12. The electric connector as set forth in claim 7, wherein a gap between a distal end of said lock-releaser and said lock arm body is smaller than said gap between said lock arm body and said surface of said housing.

* * * * *